US010364625B2

(12) United States Patent
Grace

(10) Patent No.: US 10,364,625 B2
(45) Date of Patent: Jul. 30, 2019

(54) MECHANICALLY COUPLING A BEARING ASSEMBLY TO A ROTATING CONTROL DEVICE

(71) Applicant: HALLIBURTON ENERGY SERVICES, INC., Houston, TX (US)

(72) Inventor: Christopher Allen Grace, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 263 days.

(21) Appl. No.: 15/311,257

(22) PCT Filed: Sep. 30, 2014

(86) PCT No.: PCT/US2014/058282
§ 371 (c)(1),
(2) Date: Nov. 15, 2016

(87) PCT Pub. No.: WO2016/053294
PCT Pub. Date: Apr. 7, 2016

(65) Prior Publication Data

US 2017/0114602 A1 Apr. 27, 2017

(51) Int. Cl.
*E21B 23/01* (2006.01)
*E21B 17/043* (2006.01)
(Continued)

(52) U.S. Cl.
CPC ..... *E21B 23/01* (2013.01); *E21B 17/02* (2013.01); *E21B 19/006* (2013.01); *E21B 23/006* (2013.01); *E21B 33/085* (2013.01)

(58) Field of Classification Search
CPC ..... E21B 23/01; E21B 17/043; E21B 33/085
See application file for complete search history.

(56) References Cited

U.S. PATENT DOCUMENTS 5,101,897 A 4/1992 Leismer et al.
7,159,669 B2 1/2007 Bourgoyne et al.
(Continued)

FOREIGN PATENT DOCUMENTS

WO 2014042631 3/2014

OTHER PUBLICATIONS

Halliburton Energy Services, Evo-Trieve Packer and Straddle Systems, available at http://www.halliburton.com/en-US/ps/completions/well-completions/intervention-solutions/evo-trieve-packer-and-straddle-systems.page, at least as early as Oct. 30, 2013, 1 page.
(Continued)

*Primary Examiner* — Catherine Loikith
(74) *Attorney, Agent, or Firm* — Kilpatrick Townsend & Stockton LLP

(57) ABSTRACT

A latching assembly for use in a well system is provided. The latching assembly can include an outer mandrel and a running tool coupling assembly coupled to a first longitudinal end of the outer mandrel. The running tool coupling assembly can be operable to couple to a running tool that includes a drill string component. The latching assembly can be controllable using the running tool. The latching assembly can also include a bearing coupling assembly coupled to a second longitudinal end of the outer mandrel that is opposite longitudinally with respect to the first longitudinal end. The bearing coupling assembly can be operable to couple to a bearing assembly. The latching assembly can further include a rotating control device (RCD) coupling assembly coupled to the side of the outer mandrel. The RCD coupling assembly can be operable to couple to an RCD positioned in the well system.

22 Claims, 10 Drawing Sheets

(51) Int. Cl.

| | |
|---|---|
| ***E21B 17/02*** | (2006.01) |
| ***E21B 23/00*** | (2006.01) |
| ***E21B 19/00*** | (2006.01) |
| ***E21B 33/08*** | (2006.01) |

(56) References Cited

U.S. PATENT DOCUMENTS

| | | | | |
|---|---|---|---|---|
| 7,699,109 | B2 | 4/2010 | May et al. | |
| 7,926,593 | B2 | 4/2011 | Chambers et al. | |
| 7,950,474 | B2 | 5/2011 | Leduc et al. | |
| 7,997,345 | B2 | 8/2011 | Hannegan et al. | |
| 8,286,734 | B2 | 10/2012 | Hannegan et al. | |
| 8,322,432 | B2 | 12/2012 | Bailey et al. | |
| 8,347,983 | B2 | 1/2013 | Hoyer et al. | |
| 8,381,816 | B2 | 2/2013 | Costo et al. | |
| 2004/0245020 | A1* | 12/2004 | Giroux | E21B 7/06 175/61 |
| 2008/0210471 | A1 | 9/2008 | Bailey et al. | |
| 2009/0166046 | A1 | 7/2009 | Edvardson et al. | |
| 2010/0008190 | A1 | 1/2010 | Gray et al. | |
| 2012/0000664 | A1 | 1/2012 | Nas et al. | |
| 2012/0013133 | A1 | 1/2012 | Rios, III et al. | |
| 2012/0043726 | A1 | 2/2012 | Zubia et al. | |
| 2012/0085545 | A1 | 4/2012 | Tarique et al. | |
| 2012/0125633 | A1 | 5/2012 | Linde et al. | |
| 2012/0255783 | A1 | 10/2012 | Curtis et al. | |
| 2012/0318496 | A1 | 12/2012 | Bailey et al. | |
| 2013/0206386 | A1 | 8/2013 | Bailey et al. | |

OTHER PUBLICATIONS

International Patent Application No. PCT/US2014/058282, International Preliminary Report on Patentability, dated Oct. 31, 2016, 6 pages.

International Patent Application No. PCT/US2014/058282, International Search Report and Written Opinion, dated Jun. 22, 2015, 11 pages.

Weatherford, Model 7800 Rotating Control Device, retrieved from the internet at http://www.weatherford.com/doc/wft060077, at least as early as May 23, 2014, 4 pages.

* cited by examiner

MECHANICALLY COUPLING A BEARING ASSEMBLY TO A ROTATING CONTROL DEVICE

CROSS-REFERENCE TO RELATED APPLICATIONS

This is a U.S. national phase under 35 U.S.C. 371 of International Patent Application No. PCT/US2014/058282, titled "Mechanically Coupling a Bearing Assembly to a Rotating Control Device" and filed Sep. 30, 2014, the entirety of which is incorporated herein by reference.

TECHNICAL FIELD

The present disclosure relates generally to devices for use in well systems. More specifically, but not by way of limitation, this disclosure relates to mechanically coupling a bearing assembly to a rotating control device (RCD).

BACKGROUND

A well system (e.g., oil or gas wells for extracting fluids from a subterranean formation) can include a drill rig. The drill rig can include a rotating control device (RCD). The RCD can divert fluid from the well system to specific well system equipment. The position of the RCD in the well system, however, can change depending on whether the drill rig is land-based or offshore, such as on a floating platform in the sea. For example, in a land-based drill rig, the RCD can be positioned at the well's surface. A well operator can directly connect or disconnect well components to the RCD. In an offshore drill rig, however, the RCD can be positioned in a less convenient location for the well operator. For example, the RCD can be positioned in a section of a riser that is below sea level. The riser can be a tube for transporting materials between a wellbore drilled into the seafloor and a well system component at the water's surface. In such situations, the RCD may not be easily accessible by the well operator.

DETAILED DESCRIPTION

Figure 1:
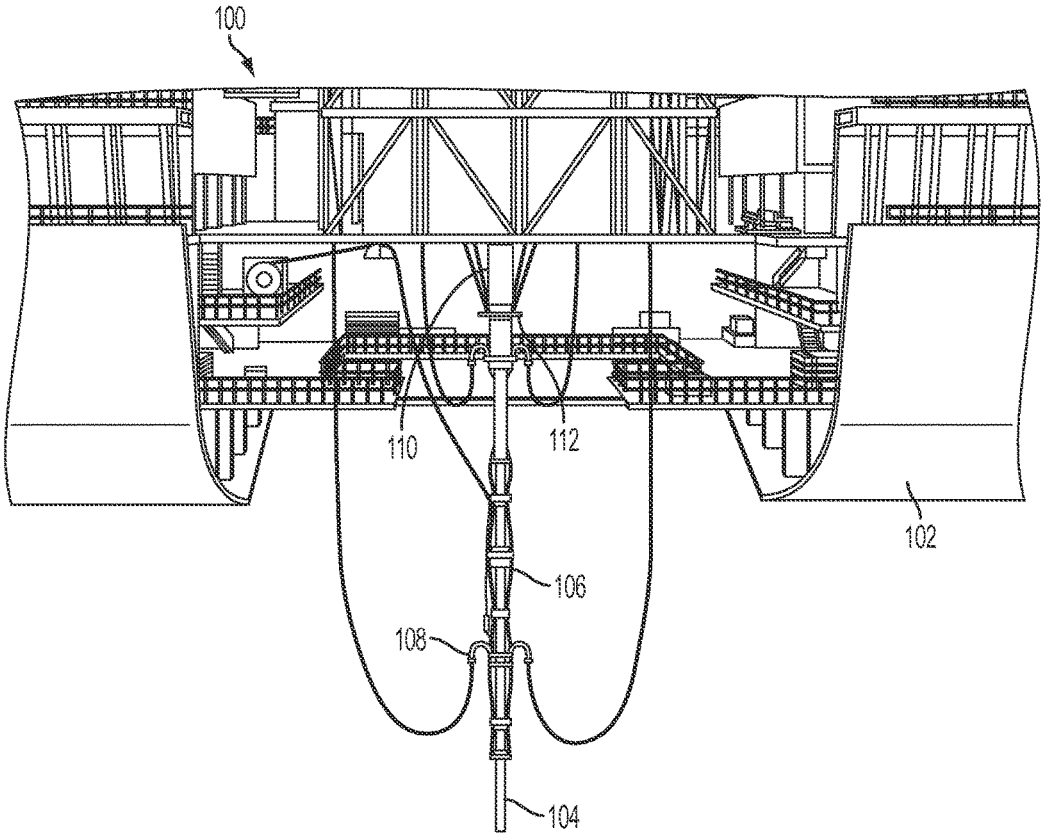
FIG. 1 is a cutaway side view of a drill rig that can include a system for mechanically coupling a bearing assembly to a rotating control device (RCD) according to one aspect of the present disclosure.

Certain aspects and features of the present disclosure are directed to mechanically coupling a bearing assembly to a rotating control device (RCD) in an offshore well system using a mechanically operated latching assembly. The latching assembly can be coupled to the bearing assembly. The latching assembly can be used as a vehicle for positioning and coupling the bearing assembly within the RCD.

The latching assembly can be coupled to a running tool (e.g., a drill string component). The latching assembly (and the bearing assembly coupled to the latching assembly) can be positioned in the well system using the running tool. For example, the running tool can be rotated and translated to transport the latching assembly to, and position the latching assembly within, the RCD. The latching assembly can also be mechanically operated using the running tool. For example, the running tool can be rotated and translated to cause the latching assembly to (i) mechanically couple with the RCD, (ii) manage hydraulic locking due to pressure differences above and below the bearing assembly, and (iii) decouple from the RCD. In some aspects, the latching assembly can be extracted from the RCD using the running tool or a separate pulling tool. For example, the running tool can be rotated and translated to transport the latching assembly from the RCD back to the well operator.

By using rotation and translation of the running tool to position and operate the latching assembly, the bearing assembly can be remotely coupled to and decoupled from the RCD, without requiring external power or communication. For example, the bearing assembly can be coupled to and decoupled from the RCD without requiring a hydraulic power source and hydraulic control lines or hoses. This can allow the bearing assembly to be easily, safely, and cheaply deployed in the well system.

In some aspects, the latching assembly can include a bearing coupling assembly. The bearing coupling assembly can be configured to attach the bearing assembly to the latching assembly. The bearing coupling assembly can include one or more pins, slots, nuts, bolts, screws, grooves, threaded bores, latches, and other components for coupling the latching assembly to the bearing assembly.

In some aspects, the latching assembly can include a running tool coupling assembly. The running tool coupling assembly can be configured to attach the running tool to the latching assembly. In some aspects, the running tool coupling assembly and the running tool can each include one or more latches (e.g., a collet latch), pins, or grooves configured to mechanically couple the running tool coupling assembly to the running tool. The running tool can be used by a well operator to remotely position the combined latching assembly and bearing assembly within the body of the RCD. For example, the running tool can include a drill string component. The running tool can be coupled to the latching assembly, and the well operator can rotate and translate the running tool to position the latching assembly within the body of (e.g., an inner diameter of) the RCD.

The latching assembly can include an RCD coupling assembly. The RCD coupling assembly can include one or more components (e.g., dogs, lugs, latches, wedges, teeth, slips, or screws) for mechanically coupling and decoupling the latching assembly to the inner diameter of the RCD. In some aspects, the RCD coupling assembly can include an angled wedge and an angled slip adjacent to the angled wedge. The well operator can manipulate the running tool to apply longitudinally downward pressure to the angled wedge. The angled wedge can be configured to move downward in response to downward pressure from the running tool. As the angled wedge moves downward, the angled wedge can push the angled slip radially outward into the inner body of the RCD. This can generate the mechanical coupling between the latching assembly and the RCD. By manipulating the running tool, the well operator can remotely couple the latching assembly to the RCD.

In some aspects, the RCD coupling assembly can include one or more sealing devices (e.g., packers). The well operator can manipulate the running tool to actuate the sealing devices. Upon actuation, the one or more sealing devices can expand radially outward from the latching assembly to generate a seal between the latching assembly and the inner diameter of the RCD. This can prevent fluid from below the latching assembly from mixing with fluid above the latching assembly.

In some aspects, the latching assembly can include a pulling tool coupling assembly. The pulling tool coupling assembly can be configured to attach a pulling tool to the latching assembly. In some aspects, the pulling tool coupling assembly and the pulling tool can each include one or more latches (e.g., a collet latch), pins, or grooves configured to mechanically couple the pulling tool coupling assembly to the pulling tool. The pulling tool can be used by a well operator to decouple and extract the combined latching assembly and bearing assembly from the body of the RCD. For example, the pulling tool can include a drill string component. A well operator can manipulate the pulling tool such that the pulling tool couples to the latching assembly. The well operator can then extract the pulling tool, along with the latching assembly (and the bearing assembly coupled to the latching assembly), from the RCD. In some aspects, the pulling tool can be the same as the running tool, and the pulling tool coupling assembly can be the same as the running tool coupling assembly.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cutaway side view of a drill rig 100 that can include a system for mechanically coupling a bearing assembly to an RCD 106 according to one aspect of the present disclosure. In this example, the drill rig 100 includes a drill ship 102. In some aspects, the drill rig 100 can include a floating platform. The drill rig 100 can be part of a well system for extracting hydrocarbons from a subterranean formation.

The drill rig 100 can include a riser 104. The riser 104 can be configured to transport material from one area in the well system to another area in the well system. For example, the riser 104 can be configured to transport fluid from a wellbore drilled into the seafloor to well system components at the water's surface.

An RCD 106 can be coupled to the riser 104. Because the drilling deck can experience motion relative to the ocean floor and the riser, it can be desirable to position the RCD 106 below a tension ring 112 and a telescopic joint 110 in the drill rig 100. With the RCD 106 positioned far from the surface of the drill rig 100 or subsea-level, however, it can be challenging for a well operator to position a bearing assembly within the RCD 106. Aspects of the present disclosure can work to resolve such challenges.

In some aspects, a flow spool 108 can be positioned below the RCD 106. The flow spool 108 can be configured to divert fluid flowing through the riser 104 to one or more well system components in the drill rig 100.

Figure 2:
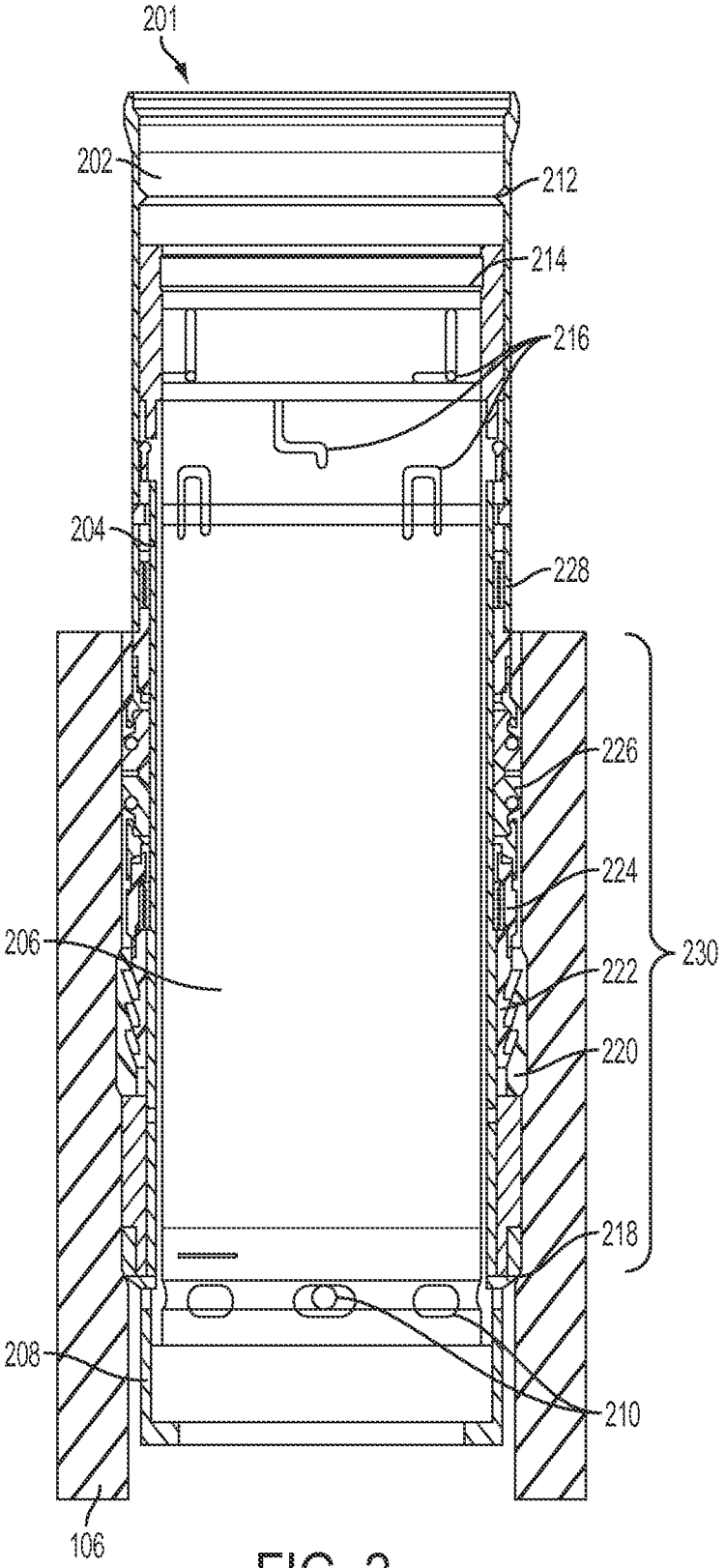
FIG. 2 is a cross-sectional side view of a latching assembly for mechanically coupling a bearing assembly to an RCD according to one aspect of the present disclosure.

FIG. 2 is a cross-sectional side view of a latching assembly 201 for mechanically coupling a bearing assembly to an RCD 106 according to one aspect of the present disclosure. The latching assembly 201 can be entirely mechanically operated using a running tool and a pulling tool (described in greater detail below).

Figure 3:
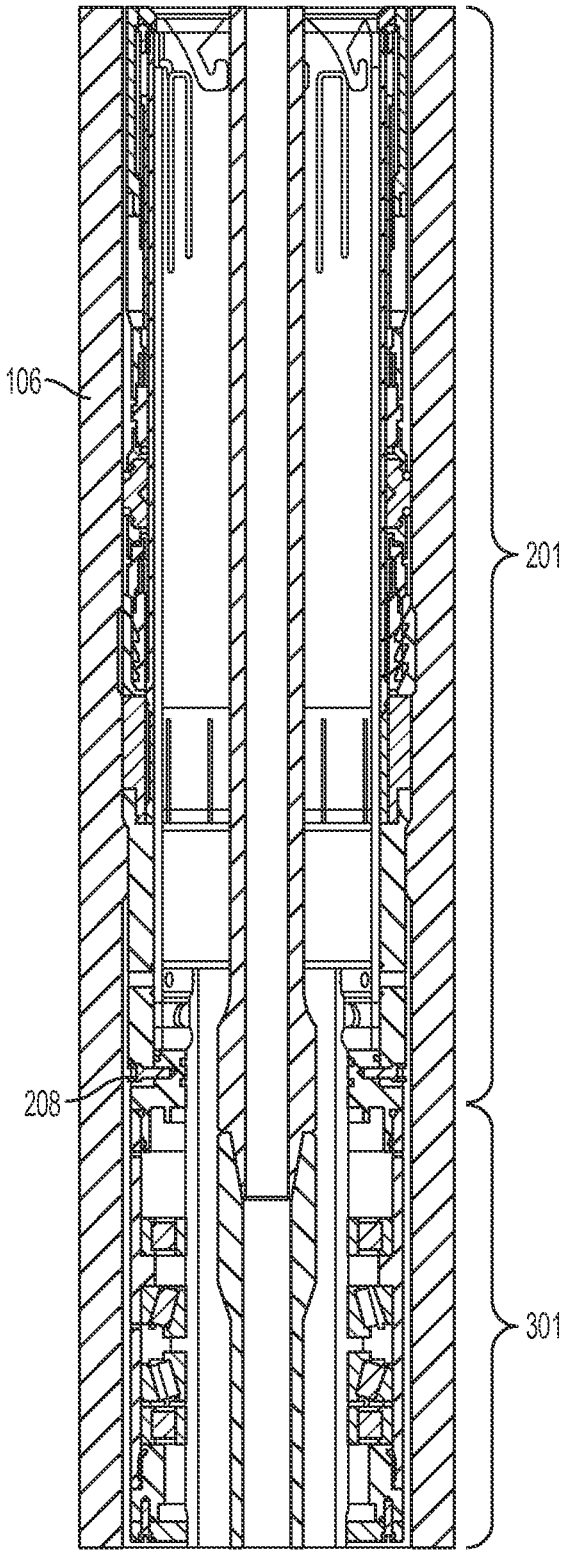
FIG. 3 is a cross-sectional side view of a latching assembly coupled to a bearing assembly according to one aspect of the present disclosure.

The latching assembly 201 can include a bearing coupling assembly 208. The bearing coupling assembly 208 can include one or more pins, slots, nuts, bolts, screws, grooves, threaded bores, latches, and other components for coupling the latching assembly 201 to a bearing assembly. In some aspects, the bearing coupling assembly 208 can be positioned at the longitudinal bottom of the latching assembly 201. This can allow the bearing assembly 301 to hang below the bottom of the latching assembly 201, as shown in FIG. 3. Other configurations, however, of the bearing coupling assembly 208 and the bearing assembly 301 are possible.

Returning to FIG. 2, a well operator can position the latching assembly 201 (and the bearing assembly coupled to the latching assembly 201) within an RCD 106. The well operator insert the latching assembly 201 into the riser 104 and use a running tool (not shown) to move the latching assembly 201 through the riser to the RCD 106. The running tool can be integrated with the drill string or include a drill string component. The well operator can rotate or translate the running tool within the riser, and thereby position the latching assembly 201 (and a bearing assembly coupled to the latching assembly 201) within the RCD 106.

The latching assembly 201 can mechanically couple with the running tool via a running tool coupling assembly 212. The running tool coupling assembly 212 can have a diameter larger than a diameter of the running tool, such that the running tool coupling assembly 212 can receive the running tool. In some aspects, the diameter of the running tool coupling assembly 212 can be slightly larger than the diameter of the running tool, so that the running tool can frictionally couple with the running tool coupling assembly 212. In other aspects, the running tool coupling assembly 212 can have a diameter smaller than an inner diameter of the running tool, such that the running tool coupling assembly 212 can fit within the inner diameter of the running tool. The running tool coupling assembly 212 and the running tool can each include one or more latches (e.g., a collet latch or collet fingers), pins, slots (e.g., J-slots, U-slots, L-slots), threaded bores, tubes, and grooves configured to mechanically couple the running tool coupling assembly 212 to the running tool. For example, the running tool can include collet fingers. The collet fingers can couple with one or more profiles or recesses in the running tool coupling assembly 212, which can mechanically couple the running tool to the running tool coupling assembly 212.

The running tool coupling assembly 212 can be coupled to an outer mandrel 202 of the latching assembly 201. The outer mandrel 202 can include a diameter that is smaller than an inner diameter of the RCD 106. This can allow the latching assembly 201 to fit within the body of the RCD 106.

The latching assembly 201 can include a center mandrel 204 positioned between the outer mandrel 202 and an inner mandrel 206. The center mandrel 204 can be fixed. In some aspects, the outer mandrel 202 and the inner mandrel 206 can rotate or translate with respect to the center mandrel 204.

In some aspects, the inner mandrel 206 can include one or more ports 210. The one or more ports 210 can include one or more holes, tubes, or seals. The one or more ports 210 can be configured to prevent against hydraulic locking. Hydraulic locking can occur if fluid or pressure prevents the latching assembly 201 from moving through the riser. For example, hydraulic locking can occur if fluid and pressure builds up within the riser and beneath the latching assembly 201, preventing the well operator from moving the latching assembly 201 downward through the riser. In some aspects, the one or more ports 210 can allow fluid to pass through or around the latching assembly 201. For example, the one or more ports 210 can allow fluid to pass from below of the latching assembly 201, through an annular space between the RCD 106 and the latching assembly 201, to above the latching assembly 201. The one or more ports 210 can also allow pressure above and below the latching assembly 201 to equalize. The fluid flow and pressure equalization afforded by the one or more ports 210 can prevent hydraulic locking.

The RCD 106 can include a stopping device 218. The stopping device 218 can help the well operator position the latching assembly 201 within the RCD 106. In some aspects, the stopping device 218 can include a shoulder. The shoulder can include a diameter that is smaller than the diameter of latching assembly 201 (e.g., the outer mandrel 202) or the bearing assembly. The shoulder can be configured to prevent the latching assembly 201 from moving beyond a location in the RCD 106. For example, as a well operator positions the latching assembly 201, the stopping device 218 can prevent the well operator from moving the latching assembly 201 further downward through the body of the RCD 106. This can allow the well operator to easily position the latching assembly 201 in a desirable location within the RCD 106.

Additionally or alternatively, the stopping device 218 and the latching assembly 201 can include one or more of a sensor (e.g., an optical sensor, strain gauge, or magnetometer), switch, button, magnet, radio frequency identification (RFID) tag, or RFID tag reader for determining a position of the latching assembly 201 within the RCD 106. In some aspects, the latching assembly 201 and stopping device 218 can transmit sensor signals associated with position of the latching assembly 201 to a computing device (e.g., at the water's surface) via a communication device. For example, the stopping device 218 can include a RFID tag reader and the latching assembly 201 can include multiple RFID tags positioned longitudinally along the outer mandrel 202. The RFID tag reader can read the RFID tags. The latching assembly 201 can transmit sensor signals associated with the RFID tags to the computing device via the communication device.

In some aspects, the communication device can include one or more of any components that facilitate a network connection. For example, the communication device can be wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication device can be wired and can include interfaces such as Ethernet, USB, or IEEE 1394. In other examples, the communication device can be configured for acoustic pulse transmission or mud pulse transmission. For instance, the communication device can transmit acoustic pulses through fluid in the well system (e.g., fluid in the riser and above the RCD 106, or fluid being transmitted from a flow spool to a drill rig component via flow lines).

The computing device can receive sensor signals via a communication device. Based on a sensor signal, the computing device can alert a well operator that the latching assembly 201 is in a certain position within the RCD 106. In some aspects, the computing device can include a processor interfaced with other hardware via a bus. A memory, which can include any suitable tangible (and non-transitory) computer-readable medium such as RAM, ROM, EEPROM, or the like, can embody program components that configure operation of the computing device. The computing device can also include input/output interface components (e.g., a display, keyboard, touch-sensitive surface, and mouse) and additional storage.

Figure 4:
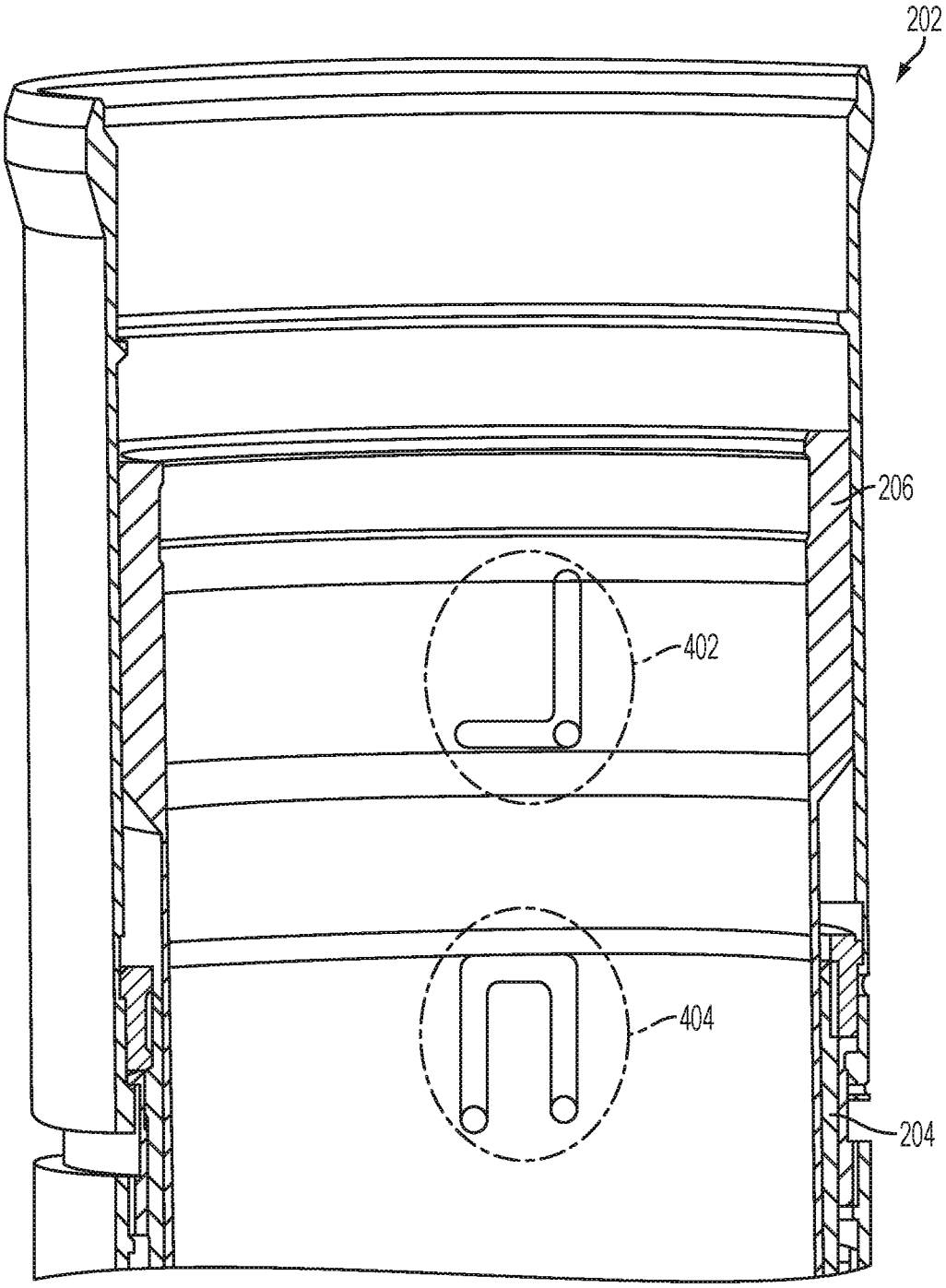
FIG. 4 is cutaway, cross-sectional side view of a portion of the latching assembly shown in FIG. 2 for mechanically coupling a bearing assembly to an RCD according to one aspect of the present disclosure.

The latching assembly 201 can include one or more guide slots 216. In some aspects, the guide slots 216 can include a J-slot, U-slot, L-slot, or any other slot configuration. A guide slot 216 can be positioned on the outer mandrel 202 and a corresponding pin can be positioned on the inner mandrel 206, or vice-versa. In the example shown in FIG. 4, a guide slot 402 (e.g., an L-slot) is positioned on the outer mandrel 202 and a corresponding pin is positioned on the inner mandrel 206. The inner mandrel 206 can be in a first position configured to allow the one or more ports 210 to communicate fluid around or through the latching assembly 201 to prevent against hydraulic locking. For example, the inner mandrel 206 can be in the first position when the latching assembly 201 is being positioned within the body of the RCD 106.

Figure 5:
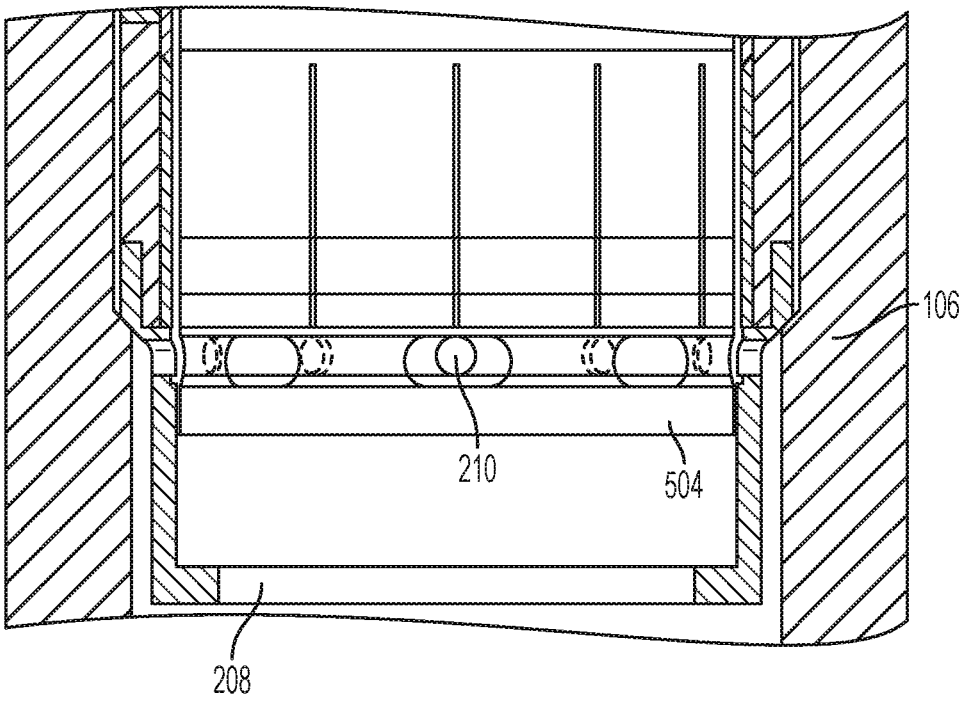
FIG. 5 is a close-up, cross-sectional side view of a portion of the latching assembly shown in FIG. 2 for mechanically coupling a bearing assembly to an RCD according to one aspect of the present disclosure.

The outer mandrel 202 can be rotated and translated, such that the pin on the inner mandrel 206 can follow a path defined by the guide slot 402 to a second position. This can occur as part of the setting operation of the latching assembly 201 within the RCD 106. The second position can cause a closure component (e.g., closure component 504 shown in FIG. 5) coupled to the inner mandrel 206 to block or seal the one or more ports 210. For example, upon the inner mandrel 206 being translated downwards, a closure component coupled to the inner mandrel 206 can block one or more of the ports 210. This can prevent fluid communication through the one or more ports 210 and generate a pressure seal. In some aspects, the closure component 504 can include an O-ring.

In some aspects, a well operator can rotate and translate the inner mandrel 206 back to the first position. For example, the well operator can use the running tool to move the inner mandrel 206 to the first position. This can cause the closure component to open the one or more ports 210. With fluid communication through the one or more ports 210 reestablished, pressure above and below the latching assembly 201 can equalize. By changing the position of the inner mandrel 206, the well operator can use the latching assembly 201 to manage pressure in the well system. In some aspects, upon pressure above and below the latching assembly 201 equalizing, the well operator may be able to extract the latching assembly 201 from the well system.

In some aspects, a slot 216 can be positioned on the center mandrel 204 and a corresponding pin can be positioned on the inner mandrel 206, or vice-versa. In the example shown in FIG. 4, a slot (e.g., a U-slot) 404 is positioned on the center mandrel 204 and a corresponding pin is positioned on the inner mandrel 206. When positioning the latching assembly 201 within the RCD 106, the slot 404 can prevent the inner mandrel 206 from rotating relative to the center mandrel 204. If the latching assembly 201 is being removed from the riser or the RCD 106 (described in further detail below), the slot 404 can allow the inner mandrel 206 to pull the center mandrel 204 longitudinally upwards, which can cause the latching assembly 201 to release from the RCD 106 (described in further detail below).

Returning to FIG. 2, in some aspects, the one or more guide slots 216 can prevent the latching assembly 201 from being prematurely set within the RCD 106. For example, as the latching assembly 201 is moved into position within the RCD 106, a pin (not shown) coupled to the center mandrel 204 can be in a first position within a slot 216 in the outer mandrel 202. The path defined by the guide slot 216 may prevent the outer mandrel 202 from moving downward with respect to the center mandrel 204. When the well operator is ready to set the latching assembly 201, the well operator can rotate and translate the outer mandrel 202, so that the pin moves through the path defined by the guide slot 216, to a second position. Once in the second position, the outer mandrel 202 can be move downward with respect to the center mandrel 204 for setting the latching assembly 201.

The latching assembly 201 can be mechanically set (i.e., secured) within the RCD 106 via an RCD coupling assembly 230. In some aspects, downward pressure can be used to actuate the RCD coupling assembly 230. For example, when positioning the latching assembly 201, the latching assembly 201 can contact a shoulder in the body of the RCD 106, preventing further movement of the latching assembly 201 through the RCD 106. Weight from the running tool and other well components, however, can continue to apply downward pressure to the outer mandrel 202. The downward pressure can actuate the RCD coupling assembly 230, as described in further detail with respect to FIG. 6 below.

Figure 6:
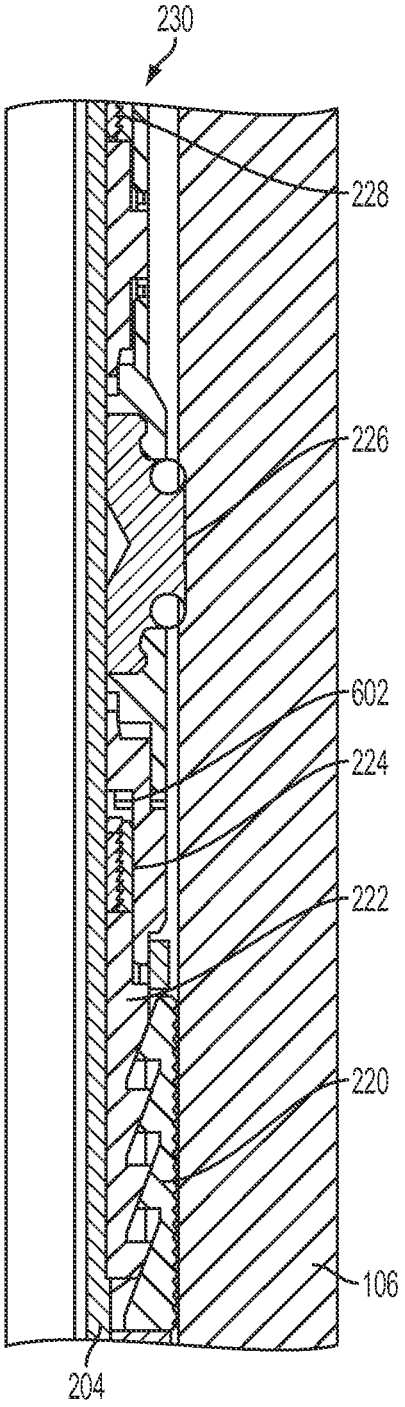
FIG. 6 is a close-up, cross-sectional side view of an RCD coupling assembly shown in FIG. 2 for mechanically coupling a bearing assembly to an RCD according to one aspect of the present disclosure.

FIG. 6 is a close-up, cross-sectional side view of the RCD coupling assembly 230 shown in FIG. 2 for mechanically coupling a bearing assembly to an RCD 106 according to one aspect of the present disclosure. The RCD coupling assembly 230 can include dogs, lugs, latches, wedges, teeth, slips, or screws. In this example, the RCD coupling assembly 230 includes an angled wedge 222 configured to move downward in response to downward pressure being applied to the latching assembly 201. As the angled wedge 222 moves downward, the angled wedge 222 can push an angled slip 220 radially outward into the inner body of the RCD 106. The angled slip 220 can include teeth (e.g., multiple sharp or pointed wedges) protruding from the surface of the angled slip 220. The teeth can enhance the mechanical coupling between the angled slip 220 and the RCD 106.

The latching assembly 201 can include a locking mechanism 224. The locking mechanism 224 can include two opposing and interlocking sets of teeth. A first set of teeth can be coupled to the center mandrel 204 and an opposing and interlocking set of teeth can be coupled to the outer mandrel 202. The locking mechanism 224 can be configured to prevent the angled wedge 222 from moving upwards, and thereby prevent the angled slip 220 from decoupling from the inner body of the RCD 106. For example, as the angled slip 220 moves radially outward, the locking mechanism 224 (e.g., positioned longitudinally above the angled wedge 222) can advance and ratchet downward. In some aspects, the locking mechanism 224 can ratchet in one direction. This can lock the angled wedge 222 and the angled slip 220 in place. One or more springs 602 (e.g., Belville washers) can be configured to help tighten the locking mechanism 224 as the latching assembly 201 is set.

The latching assembly 201 can include a sealing device 226. In some aspects, the sealing device 226 can include a packer (e.g., an inflatable packer, a cylindrical elastomer packer, or a V-packer). The sealing device 226 can be configured to create a seal between the latching assembly 201 and the RCD 106. The seal can be a pressure seal or a fluid seal. As the latching assembly 201 is set, the sealing device 226 can compress longitudinally under pressure. For example, once the angled wedge 222 has driven the angle slip 220 radially outward as far as it can go, the sealing device 226 can begin to compress. As the sealing device 226 compresses longitudinally, it can expand radially outward. This can form a seal between the latching assembly 201 and the RCD 106.

The latching assembly 201 can include a seal locking mechanism 228 for locking the sealing device 226 in place. The seal locking mechanism 228 can be positioned, for example, above the sealing device 226. The seal locking mechanism 228 can include two opposing and interlocking sets of teeth. A first set of teeth can be coupled to the center mandrel 204 and an opposing and interlocking set of teeth can be coupled to the outer mandrel 202. In some aspects, the seal locking mechanism 228 can ratchet in one direction. As the sealing device 226 compresses longitudinally (and expands radially outward), the sealing locking mechanism 228 can advance and ratchet downward. This can secure the sealing device 226 in position, preventing the sealing device 226 from decompressing and retracting radially inward.

Returning to FIG. 2, in some aspects, the latching assembly 201 can be extracted from the well system using a pulling tool (not shown). The pulling tool can be integrated with the drill string or include a drill string component. The pulling tool can be configured to mechanically couple with the latching assembly 201. The well operator can couple the pulling tool to the latching assembly 201, and can rotate and translate the pulling tool to extract the latching assembly 201 (and the bearing assembly coupled to the latching assembly 201) from the well system.

The latching assembly 201 can mechanically couple with the pulling tool via a pulling tool coupling assembly 214. The pulling tool coupling assembly 214 can have a diameter larger than a diameter of the pulling tool, such that the pulling tool coupling assembly 214 can receive the pulling tool. In some aspects, the diameter of the pulling tool coupling assembly 214 can be slightly larger than the diameter of the pulling tool, so that the pulling tool can frictionally couple with the pulling tool coupling assembly 214. In other aspects, the pulling tool coupling assembly 214 can have a diameter smaller than an inner diameter of the pulling tool, such that the pulling tool coupling assembly 214 can fit within the inner diameter of the pulling tool. In some aspects, the pulling tool coupling assembly 214 and the pulling tool can each include one or more latches (e.g., a collet latch or collet fingers), pins, slots (e.g., J-slots, U-slots, L-slots), threaded bores, tubes, and grooves configured to mechanically couple the pulling tool coupling assembly 214 to the pulling tool. For example, the pulling tool can include collet fingers. The collet fingers can couple with one or more profiles or recesses in the pulling tool coupling assembly 214, which can mechanically couple the pulling tool to the pulling tool coupling assembly 214. In some aspects, the pulling tool can be the same as the running tool, and the pulling tool coupling assembly 214 can be the same as the running tool coupling assembly 212.

Figure 7:
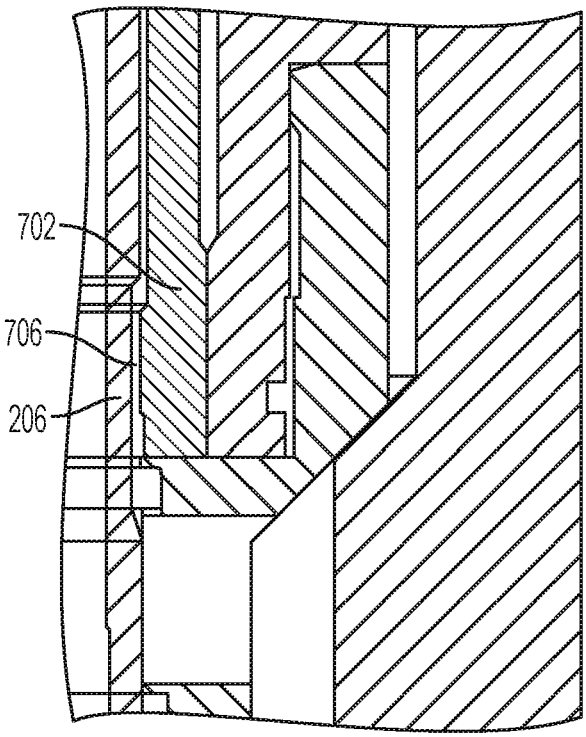
FIG. 7 is a close-up, cross-sectional side view of a portion of the latching assembly shown in FIG. 2 for mechanically coupling a bearing assembly to an RCD according to one aspect of the present disclosure.

The pulling tool coupling assembly 214 can be coupled to the inner mandrel 206. The well operator can translate the pulling tool upwards, for example, to extract the latching assembly 201 from the well system. This can translate the inner mandrel 206 upwards with respect to the center mandrel 204 and the outer mandrel 202. Turning to FIG. 7, as the inner mandrel 206 translates upwards, a recess 706 in the inner mandrel 206 can allow collet fingers 702 coupled to the bottom of the center mandrel 204 to spring radially inwards. In some aspects, the collet fingers 702 can be machined into the center mandrel 204. The collet fingers 702 can engage with the inner mandrel 206, such that the center mandrel 204 can move upwards with the inner mandrel 206. In some aspects, a guide slot (e.g., an L-slot) on the inner mandrel 206 can additionally or alternatively allow the center mandrel 204, which can include a pin corresponding to the guide slot, to translate upwards with the inner mandrel 206.

As the center mandrel 204 moves upwards, the first set of teeth within the seal locking mechanism 228 and coupled to the center mandrel 204 can move upward. The first set of teeth within the locking mechanism 224 and coupled to the center mandrel 204 can also move upwards. This can disengage the seal locking mechanism 228 and the locking mechanism 224, which can allow the sealing device 226 to relax and the angled wedge 222 to become moveable, respectively. With the angled wedge 222 moveable, the angled slip 220 can retract radially inward, which can cause the angled slip 220 to decouple from the body of the RCD 106. One or more springs (not shown) coupled to the angled slip 220 can help the angled slip 220 retract radially inward. In some aspects, the well operator can extract the latching assembly 201 (and the bearing assembly coupled to the latching assembly 201) from the well system.

Figure 8:
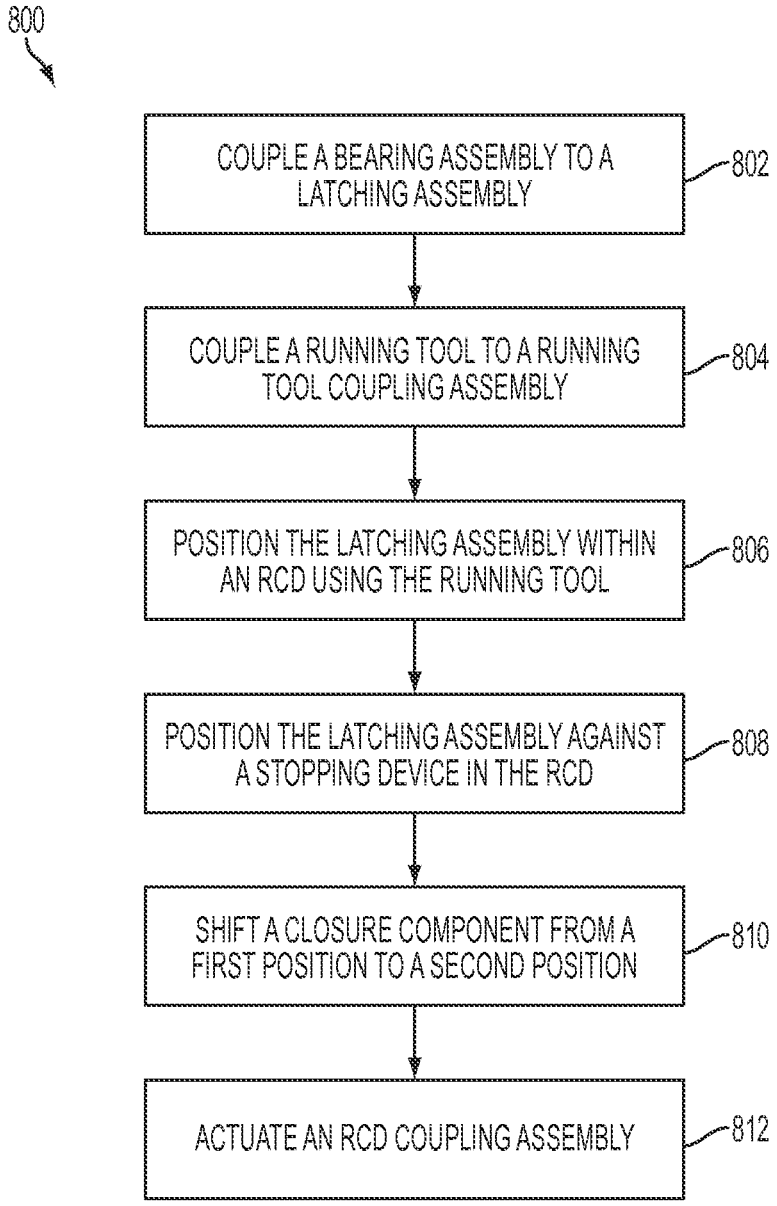
FIG. 8 is an example of a flow chart of a process for mechanically coupling a bearing assembly to an RCD according to one aspect of the present disclosure.

FIG. 8 is an example of a flow chart of a process 800 for mechanically coupling a bearing assembly to an RCD according to one aspect of the present disclosure.

In block 802, a bearing assembly is coupled to a latching assembly. In some aspects, the bearing assembly can be coupled to the latching assembly via a bearing coupling assembly. The bearing coupling assembly can include one or more latches, threaded bores, screws, buts, bolts, slots, grooves, or other components for coupling the bearing assembly to the latching assembly. A well operator can, for example, screw a bolt through the bearing coupling assembly and into a screw hole in the bearing assembly to couple the bearing coupling assembly to the bearing assembly. The latching assembly can also include a running tool coupling assembly and an RCD coupling assembly.

In block 804, a running tool is coupled to the running tool coupling assembly. The running tool coupling assembly can include one or more latches, threaded bores, screws, buts, bolts, slots, grooves, or other components for coupling the running tool to the latching assembly. A well operator can, for example, rotate the running tool within the running tool coupling assembly, such that one or more latches in the running tool coupling assembly couple with the running tool.

In block 806, the latching assembly is positioned, using the running tool, within the RCD. The RCD can be positioned in a riser in a well system. The latching assembly can be inserted into the riser and manipulated (e.g., rotated and translated) via the running tool until the latching assembly is positioned within an inner diameter of the RCD.

In block 808, the latching assembly is positioned against a stopping device in the body of the RCD. In some aspects, the stopping device can include a shoulder with diameter configured to stop the latching assembly from moving beyond a point within the RCD body. A well operator can rotate and translate the running tool, and thereby rotate and translate the latching assembly within the RCD body, until the latching assembly is positioned against the shoulder.

In block 810, the RCD coupling assembly is actuated to couple the latching assembly to the RCD body. In some aspects, the RCD coupling assembly can be actuated by rotating or translating the running tool to apply pressure to the outer mandrel of the latching assembly. The pressure can cause the outer mandrel to move an angled wedge downward, which can cause an angled slip to be pushed radially outward from the latching assembly into the body of the RCD. This can affix the latching assembly within the RCD.

In block 814, a closure component shifts from a first position to a second position. The closure component can be coupled to the inner mandrel and shift based on the translation and rotation of the inner mandrel. In some aspects, the first position can be configured to cause the closure component to allow a fluid communication through a port in the inner mandrel. The second position can be configured to cause the closure component to inhibit fluid communication through the port in the inner mandrel. In some aspects, the closure component can include a seal (e.g., an O-ring) for preventing fluid from flowing through the port when in the second position.

Figure 9:
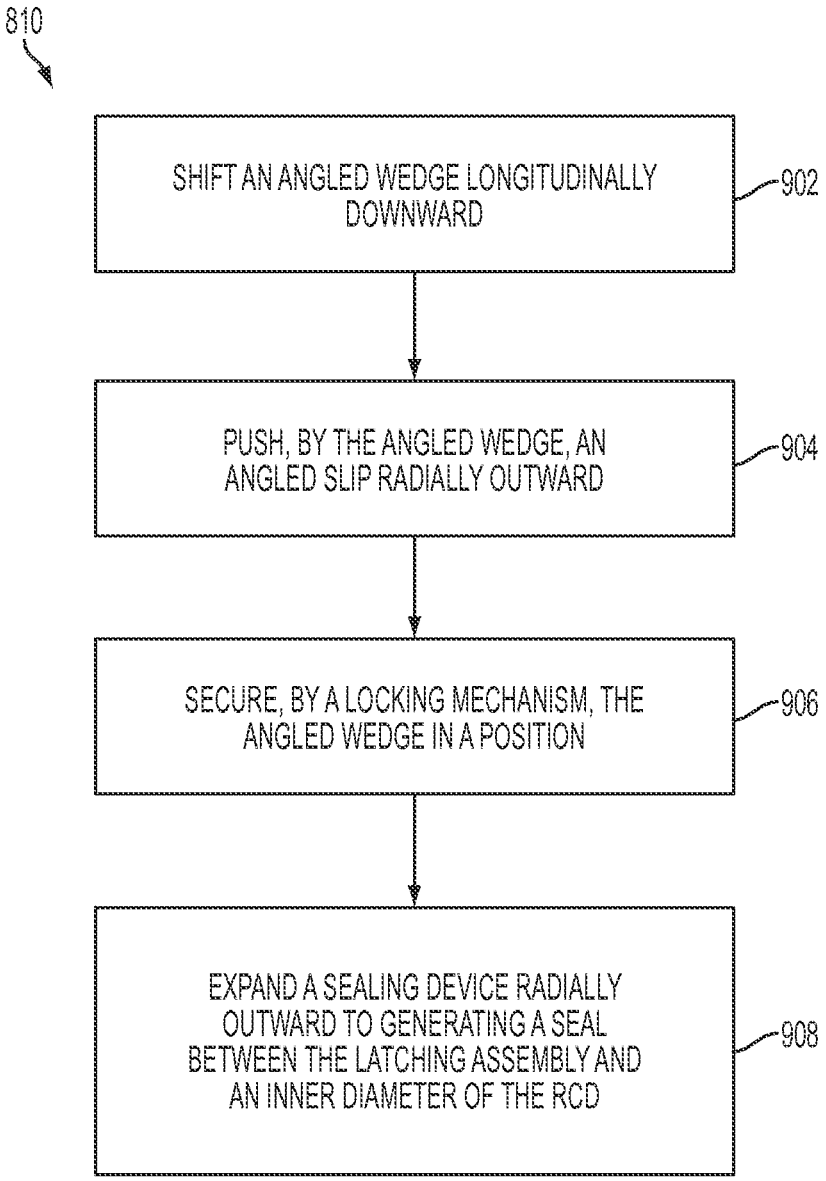
FIG. 9 is an example of a flow chart of a process for actuating an RCD coupling assembly according to one aspect of the present disclosure.

FIG. 9 is an example of a flow chart of a process 900 for actuating an RCD coupling assembly (e.g., block 810 from FIG. 8) according to one aspect of the present disclosure.

In block 902, an angled wedge shifts longitudinally downward along a body of the latching assembly. The angled wedge can move downward as a result of downward pressure on the latching assembly. For example, downward pressure applied by the running tool to the latching assembly can cause an outer mandrel of the latching assembly to move longitudinally downward. The angled wedge can be coupled to the outer mandrel and also move longitudinally downward with the outer mandrel.

In block 904, the angled wedge pushes an angled slip radially outward. One or more grooves in the angled wedge can oppose one or more grooves in the angled slip. As the angled wedge shifts downward, the grooves in the angled wedge can press against the grooves in the angled slip, causing the angled slip to move radially outward.

In block 906, a locking mechanism secures the angled wedge in a position. The locking mechanism can include, for example, a one-way ratchet, and be coupled to the angled wedge. As the angled wedge moves downward, the locking mechanism can ratchet. The locking mechanism can prevent the angled wedge from moving upward, until the locking mechanism is released.

In block 908, a sealing device expands radially outward from the latching assembly to generate a seal between the latching assembly and an inner diameter of the RCD. In some aspects, the sealing device can be inflatable and inflate in a radially outward direction. In other aspects, the sealing device can expand radially outward as a result of compression pressure from the running tool pushing downward on the latching assembly.

Figure 10:
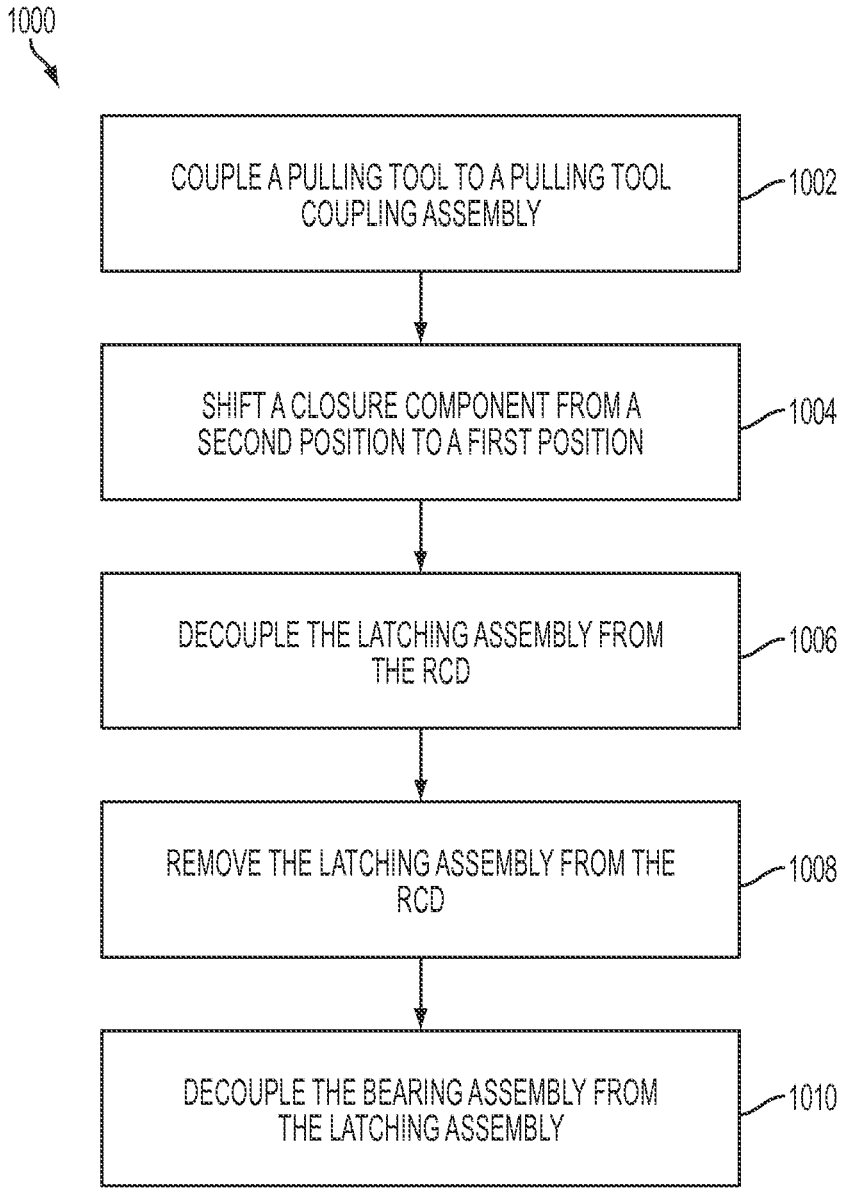
FIG. 10 is an example of a flow chart of a process for removing a bearing assembly from an RCD according to one aspect of the present disclosure.

FIG. 10 is an example of a flow chart of a process 1000 for removing a bearing assembly from an RCD according to one aspect of the present disclosure.

In block 1002, a pulling tool is coupled to a pulling tool coupling assembly attached to the latching assembly. The pulling tool coupling assembly can include one or more latches, threaded bores, screws, buts, bolts, slots, grooves, or other components for coupling the pulling tool to the latching assembly. A well operator can, for example, rotate the pulling tool within the pulling tool coupling assembly, such that one or more latches in the pulling tool coupling assembly couple with the pulling tool.

In block 1004, a closure component shifts from a second position to a first position. The closure component can be coupled to the inner mandrel and shift based on the translation and rotation of the inner mandrel. In some aspects, the second position can be configured to cause the closure component to inhibit fluid communication through the port in the inner mandrel. The first position can be configured to cause the closure component to allow a fluid communication through a port in the inner mandrel. In some aspects, upon shifting the closure component from the second position to the first position, fluid communication through the port in the inner mandrel can be reestablished, and the port can allow pressure above and below the latching assembly to equalize.

In block 1006, the latching assembly is decoupled from the RCD. In some aspects, the well operator can rotate and translate the pulling tool, causing one or more mandrels within the latching assembly to rotate or translate. This can cause a sealing device or other component of the RCD coupling assembly to relax, loosening the mechanical coupling between the latching assembly and the body of the RCD.

In block 1008, the latching assembly is removed from the RCD. The well operator can remove the latching assembly from the RCD by translating the pulling tool in a direction until the latching assembly is no longer within the RCD. In some aspects, the well operator can, using the pulling tool, remove the latching assembly (and a bearing assembly coupled to the latching assembly) from the riser or well system.

In block 1010, the bearing assembly is decoupled from the latching assembly. In some aspects, the well operator can unhinge or unscrew the bearing assembly from the latching assembly. This may allow the well operator to replace the bearing assembly or latching assembly, or perform other maintenance on the bearing assembly or latching assembly.

In some aspects, a system for mechanically coupling a bearing assembly to a RCD body is provided according to one or more of the following examples:

Example #1

A latching assembly for use in a well system can include an outer mandrel. The latching assembly can also include a running tool coupling assembly coupled to a first longitudinal end of the outer mandrel, the running tool coupling assembly being operable to couple to a running tool comprising a drill string component. The latching assembly can be controllable using the running tool. The latching assembly can further include a bearing coupling assembly coupled to a second longitudinal end of the outer mandrel that is opposite longitudinally with respect to the first longitudinal end. The bearing coupling assembly can be operable to couple to a bearing assembly. The latching assembly can also include a rotating control device (RCD) coupling assembly coupled to a side of the outer mandrel. The RCD coupling assembly can be operable to couple to an RCD positioned in the well system.

Example #2

The latching assembly of Example #1 may feature the RCD coupling assembly including an angled wedge operable to push an angled slip radially outward.

Example #3

The latching assembly of any of Examples #1-2 may feature the angled slip concluding multiple of pointed wedges protruding from a surface of the angled slip. The multiple pointed wedges can be operable to secure the angled slip against a body of the RCD. The RCD coupling assembly can further include a ratchet operable to secure the angled wedge in a position.

Example #4

The latching assembly of any of Examples #1-3 may feature the RCD coupling assembly further including a sealing device operable to generate a seal between the latching assembly and the body of the RCD.

Example #5

The latching assembly of Example #4 may feature the RCD coupling assembly further including a seal locking mechanism operable to secure the sealing device in another position.

Example #6

The latching assembly of any of Examples #4-5 may feature an inner mandrel positioned within the outer mandrel. The latching assembly may also feature a center mandrel positioned between the inner mandrel and the outer mandrel.

Example #7

The latching assembly of Example #6 may feature the inner mandrel including a port operable to allow a fluid communication between a point in the well system longitudinally below the sealing device and another point in the well system longitudinally above the sealing device.

Example #8

The latching assembly of Example #7 may feature a closure component coupled to the inner mandrel. The closure component can move between (i) a first position operable to allow the fluid communication through the port, and (ii) a second position operable to inhibit the fluid communication through the port.

Example #9

The latching assembly of any of Examples #6-8 may feature a pulling tool coupling assembly coupled to the inner mandrel. The pulling tool coupling assembly can be operable to couple the latching assembly to a pulling tool.

Example #10

The latching assembly of any of Examples #6-9 may feature the center mandrel including a slot and the inner mandrel including a pin positioned within the slot, or the inner mandrel including the slot and the center mandrel including the pin positioned within the slot. The slot can be operable to prevent the center mandrel from rotating with respect to the inner mandrel and to allow the center mandrel to translate longitudinally with respect to the inner mandrel.

Example #11

The latching assembly of any of Examples #1-10 may feature an inner diameter of the RCD including a shoulder at a position. The shoulder can prevent the latching assembly from moving through the inner diameter of the RCD beyond the position.

Example #12

A method can include coupling a bearing assembly to a latching assembly. The latching assembly can include a running tool coupling assembly and a rotating control device (RCD) coupling assembly. The method can also include coupling a running tool to the running tool coupling assembly, and positioning, using the running tool, the latching assembly within an RCD. The method can further include actuating the RCD coupling assembly to couple the latching assembly to the RCD.

Example #13

The method of Example #12 may feature actuating the RCD coupling assembly by: shifting an angled wedge longitudinally downward; pushing, by the angled wedge, an angled slip radially outward; and securing, by a locking mechanism, the angled wedge in a position.

Example #14

The method of any of Examples #12-13 may feature actuating the RCD coupling assembly by: expanding a sealing device radially outward to generate a seal between the latching assembly and an inner diameter of the RCD.

Example #15

The method of any of Examples #12-14 may feature positioning the latching assembly against a stopping device operable to stop the latching assembly from moving through the RCD beyond a position.

Example #16

The method of any of Examples #12-15 may feature rotating an inner mandrel positioned within the latching assembly. The method may also feature shifting, based on rotating the inner mandrel, a closure component coupled to the inner mandrel from (i) a first position operable to allow a fluid communication through a port to (ii) a second position operable to inhibit the fluid communication through the port.

Example #17

The method of any of Examples #12-16 may feature coupling a pulling tool to a pulling tool coupling assembly. The latching assembly can include the pulling tool coupling assembly. The method may also feature decoupling the latching assembly from the RCD. The method may further feature removing the latching assembly from the RCD. The method may also feature decoupling the bearing assembly from the latching assembly.

Example #18

A system can include a latching assembly. The latching assembly can include an outer mandrel. The latching assembly can also include a running tool coupling assembly coupled to the outer mandrel. The running tool coupling assembly can be operable to couple to a running tool comprising a drill string component. The latching assembly can be controllable using the running tool. The latching assembly can also include an RCD coupling assembly coupled to a side of the outer mandrel. The RCD coupling assembly can be operable to couple to an RCD. The latching assembly can further include a bearing coupling assembly coupled to the outer mandrel. The system can also include a bearing assembly operable to couple with the bearing coupling assembly. The system can further include the RCD. The RCD can be positioned in a well system.

Example #19

The system of Example #18 may feature the latching assembly further including an inner mandrel positioned within the outer mandrel. The latching assembly may further include a center mandrel positioned between the inner mandrel and the outer mandrel. The center mandrel can include a slot and the inner mandrel can include a pin positioned within the slot. Or the inner mandrel can include the slot and the center mandrel can include the pin positioned within the slot. The slot can be operable to prevent the center mandrel from rotating with respect to the inner mandrel and to allow the center mandrel to translate longitudinally with respect to the inner mandrel.

Example #20

The system of any of Examples #18-19 may feature a port operable to allow a fluid communication between the latching assembly and an inner diameter of the RCD. The system may also feature a closure component moveable between (i) a first position operable to allow the fluid communication through the port, and (ii) a second position operable to inhibit the fluid communication through the port.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A latching assembly for use in a well system, the latching assembly comprising:

an outer mandrel;

a running tool coupling assembly positioned at a first longitudinal end of the outer mandrel, the running tool coupling assembly being operable to couple to a running tool comprising a drill string component, wherein the latching assembly is controllable using the running tool;

a bearing coupling assembly positioned at a second longitudinal end of the outer mandrel that is opposite longitudinally with respect to the first longitudinal end, the bearing coupling assembly being operable to couple to a bearing assembly; and a rotating control device (RCD) coupling assembly positioned on a side of the outer mandrel, the RCD coupling assembly being operable to couple to an RCD positioned in the well system.

2. The latching assembly of claim 1, wherein the RCD coupling assembly comprises an angled wedge operable to push an angled slip radially outward.

3. The latching assembly of claim 2, wherein the angled slip comprises a plurality of pointed wedges protruding from a surface of the angled slip and operable to secure the angled slip against a body of the RCD, and wherein the RCD coupling assembly further comprises a ratchet operable to secure the angled wedge in a position.

4. The latching assembly of claim 3, wherein the RCD coupling assembly further comprises a sealing device operable to generate a seal between the latching assembly and the body of the RCD.

5. The latching assembly of claim 4, wherein the RCD coupling assembly further comprises a seal locking mechanism operable to secure the sealing device in another position.

6. The latching assembly of claim 4, further comprising:

an inner mandrel positioned within the outer mandrel; and a center mandrel positioned between the inner mandrel and the outer mandrel.

7. The latching assembly of claim 6, wherein the inner mandrel comprises a port operable to allow a fluid communication between a point in the well system longitudinally below the sealing device and another point in the well system longitudinally above the sealing device.

8. The latching assembly of claim 7, further comprising a closure component coupled to the inner mandrel, wherein the closure component is moveable between (i) a first position operable to allow the fluid communication through the port, and (ii) a second position operable to inhibit the fluid communication through the port.

9. The latching assembly of claim 6, further comprising a pulling tool coupling assembly coupled to the inner mandrel, wherein the pulling tool coupling assembly is operable to couple the latching assembly to a pulling tool.

10. The latching assembly of claim 6, wherein the center mandrel comprises a slot and the inner mandrel comprises a pin positioned within the slot, or the inner mandrel comprises the slot and the center mandrel comprises the pin positioned within the slot, wherein the slot is operable to prevent the center mandrel from rotating with respect to the inner mandrel and to allow the center mandrel to translate longitudinally with respect to the inner mandrel.

11. The latching assembly of claim 1, wherein an inner diameter of the RCD comprises a shoulder at a position, and wherein the shoulder is operable to prevent the latching assembly from moving through the inner diameter of the RCD beyond the position.

12. The latching assembly of claim 1, wherein the latching assembly is sized to fit internally to the RCD.

13. The latching assembly of claim 1, wherein the latching assembly is configured to mechanically couple to the RCD in response to manipulation by the running tool by causing the RCD coupling assembly to expand radially outwardly and engage with an inner wall of the RCD.

14. A method comprising:

coupling a bearing assembly to an outer mandrel of a latching assembly, wherein the latching assembly comprises:

a running tool coupling assembly positioned on the outer mandrel; and a rotating control device (RCD) coupling assembly positioned on a side of the outer mandrel;

coupling a running tool to the running tool coupling assembly;

positioning, using the running tool, the latching assembly within an RCD; and actuating the RCD coupling assembly to couple the latching assembly to the RCD.

15. The method of claim 14, wherein actuating the RCD coupling assembly comprises:

shifting an angled wedge longitudinally downward;

pushing, by the angled wedge, an angled slip radially outward; and securing, by a locking mechanism, the angled wedge in a position.

16. The method of claim 14, wherein actuating the RCD coupling assembly comprises:

expanding a sealing device radially outward to generate a seal between the latching assembly and an inner diameter of the RCD.

17. The method of claim 14, further comprising:

positioning the latching assembly against a stopping device operable to stop the latching assembly from moving through the RCD beyond a position.

18. The method of claim 14, further comprising:

rotating an inner mandrel positioned within the latching assembly;

shifting, based on rotating the inner mandrel, a closure component coupled to the inner mandrel from (i) a first position operable to allow a fluid communication through a port to (ii) a second position operable to inhibit the fluid communication through the port.

19. The method of claim 14, further comprising:

coupling a pulling tool to a pulling tool coupling assembly, wherein the latching assembly comprises the pulling tool coupling assembly;

decoupling the latching assembly from the RCD;

removing the latching assembly from the RCD; and decoupling the bearing assembly from the latching assembly.

20. A system comprising:

a latching assembly, wherein the latching assembly comprises:

an outer mandrel;

a running tool coupling assembly positioned on the outer mandrel, the running tool coupling assembly being operable to couple to a running tool, wherein the latching assembly is controllable using the running tool;

a rotating control device (RCD) coupling assembly positioned on a side of the outer mandrel, the RCD coupling assembly being operable to couple to an RCD; and a bearing coupling assembly positioned on the outer mandrel; and a bearing assembly operable to couple with the bearing coupling assembly.

21. The system of claim 20, wherein the latching assembly further comprises:

an inner mandrel positioned within the outer mandrel; and a center mandrel positioned between the inner mandrel and the outer mandrel, wherein the center mandrel comprises a slot and the inner mandrel comprises a pin positioned within the slot, or wherein the inner mandrel comprises the slot and the center mandrel comprises the pin positioned within the slot, wherein the slot is operable to prevent the center mandrel from rotating with respect to the inner mandrel and to allow the center mandrel to translate longitudinally with respect to the inner mandrel.

22. The system of claim 21, wherein the inner mandrel comprises:

a port operable to allow a fluid communication between the latching assembly and an inner diameter of the RCD; and a closure component moveable between (i) a first position operable to allow the fluid communication through the port, and (ii) a second position operable to inhibit the fluid communication through the port.

* * * * *